United States Patent [19]

Fujikawa et al.

[11] Patent Number: 4,538,568

[45] Date of Patent: Sep. 3, 1985

[54] TWO-STROKE CYCLE MULTISPARK IGNITION TYPE GASOLINE ENGINE

[75] Inventors: Tetsuzo Fujikawa, Kobe; Shinji Abe, Akashi, both of Japan

[73] Assignee: Kawasaki Jukogyo Kabushiki Kaisha, Japan

[21] Appl. No.: 599,604

[22] Filed: Apr. 16, 1984

Related U.S. Application Data

[63] Continuation-in-part of Ser. No. 330,841, Dec. 15, 1981, abandoned.

[30] Foreign Application Priority Data

Dec. 22, 1980 [JP] Japan ..... 55-182398

[51] Int. Cl.[3] ..... F02P 15/02

[52] U.S. Cl. ..... 123/310; 123/638; 123/661

[58] Field of Search ..... 123/661, 310, 636, 638, 123/602

[56] References Cited

U.S. PATENT DOCUMENTS

| | | | |
|---|---|---|---|
| 2,898,898 | 8/1959 | Burch | 123/661 |
| 3,229,676 | 1/1966 | Ulbing | 123/661 |
| 4,064,858 | 12/1977 | Forde | 123/638 |
| 4,079,712 | 3/1978 | Nagasawa | 123/602 |
| 4,100,736 | 7/1978 | Nakajima et al. | 123/638 |
| 4,162,661 | 7/1979 | Nakanishi et al. | 123/661 |
| 4,175,509 | 11/1979 | Orova et al. | 123/418 |
| 4,324,214 | 4/1982 | Garcea | 123/661 |
| 4,335,692 | 6/1982 | Miura | 123/418 |
| 4,377,997 | 3/1983 | Staerzl | 123/418 |

FOREIGN PATENT DOCUMENTS

| | | | |
|---|---|---|---|
| 1075106 | 4/1980 | Canada | 123/310 |
| 2704721 | 8/1977 | Fed. Rep. of Germany | 123/638 |
| 0022613 | 2/1977 | Japan | 123/310 |
| 153927 | 12/1980 | Japan . | |
| 0203818 | 12/1982 | Japan | 123/661 |
| 0017896 | of 1906 | United Kingdom | 123/638 |
| 0527903 | 10/1940 | United Kingdom | 123/310 |

*Primary Examiner*—Parshotam S. Lall

*Attorney, Agent, or Firm*—Leydig, Voit, Osann, Mayer and Holt, Ltd.

[57] ABSTRACT

An internal combustion engine of the spark ignition type developing a maximum output power at about 8000 rpm includes at least two ignition plugs for each cylinder and projections formed on the inner wall surface of a cylinder head for producing a squishy current. The engine also includes an ignition device including a delay circuit for delaying the ignition time in the high-speed rotation range, to thereby provide improvements in the output power and fuel consumption rate over the entire rotation range.

3 Claims, 11 Drawing Figures

TWO-STROKE CYCLE MULTISPARK IGNITION TYPE GASOLINE ENGINE

This application is a continuation-in-part of application Ser. No. 330,841, filed Dec. 15, 1981, now abandoned.

BACKGROUND OF THE INVENTION

This invention relates to spark ignition type internal combuation engines in general, and more particularly it is concerned with a two-cycle internal combustion engine of the type described capable of developing high output power and operating at high speed.

Heretofore, it has been usual practice to design two stroke cycle spark ignition type internal combustion engines of light weight capable of developing high output power with an eye on increasing output power while reducing a fuel consumption rate, particularly in a high-speed rotation range (over about 6000 rpm), at the cost of economy on fuel consumption in low- and medium-speed rotation ranges. However, there has in recent years been a demand for an improved fuel consumption rate in all the rotation ranges in this type of engine, and it is known that proposals have been made to use an ignition device as a means for solving the problem which optimizes ignition timing in all the rotation ranges. However, a two-cycle spark ignition type internal combustion engine capable of developing high output power and operating at high speed has a specific ignition characteristic. More specifically, when it is desired to prevent abnormal combustion that might occur due to an inordinate delay in ignition at high speed rotation, the desired ignition timing characteristic for this type of engine is such that the ignition advancer is delayed in a high-speed rotation range as compared with low- and medium-speed rotation range. Particularly, if the air-fuel ratio of a fuel-air mixture is made nearer to the theoretical air-fuel ratio rather than being enriched for improving fuel consumption in the high-speed rotation range, then the rate of occurrence of abnormal combustion increases sharply, and one is forced to further delay the ignition timing to avoid damage to the engine due to the abnormal combustion. Thus the ignition timing for the high-speed rotation range is markedly delayed in the high-speed rotation range than in the low- and medium-speed rotation ranges.

However, it is difficult for an ordinary ignition device (an ordinary contactless ignition device, for example) of low cost to satisfy the aforesaid advance requirements over the entire rotation range, and in actual practice there is the tendency that the output power and the fuel consumption rate in the low- and medium speed rotation ranges are sacrificed because the ignition timing for the high-speed rotation range is important for improving the fuel consumption rate and preventing abnormal combustion.

Meanwhile rapid combustion is effective in improving thermal efficiency in a spark ignition type internal combustion engine. However, in a two-cycle engine capable of developing high output power and operating at high speed, rapid combustion at high speed operation and at high load causes a marked rise in the temperature of combustion gas in the cylinders, so that what is referred to as a knock phenomenon may occur and cause ignition to take place by the spreading flames prior to initiation of ignition. When this phenomenon happens, a large quantity of heat is transmitted to the walls of the combustion chamber and the piston over the above the ability thereof to dissipate heat, resulting in the development of seizure.

A proposal has been made to use means for reducing the volume of the exhaust per cylinder and increasing the number of the cylinders to reduce the distance that should be covered by the flames when they spread, in order to effect rapid combustion and yet to prevent abnormal combustion. However, such means cannot be used in other engines than stationary engines because of an increase in the weight of the engine. Another means available relies on the provision of a plurality of ignition plugs for each cylinder to reduce the distance that should be covered by the flames when they spread. However, such means would suffer the aforesaid disadvantage of being unable to satisfactorily prevent abnormal combustion in the high-speed rotation range because of a reduction in the delay in ignition and the rapid progress of combustion, although improvements might be provided to the output power and the fuel consumption rate in the low- and medium-speed rotation ranges. If an enriched mixture is used with the aforesaid means to avoid abnormal combustion, then the fuel consumption rate in the high-speed rotation range would worsen, and it would become necessary to use a special fuel supply means for supplying an enriched mixture to the engine only in the high-speed rotation range, because the use of an ordinary cheap fuel supply means would result in an enriched mixture being fed to the engine even in the low- and medium-speed rotation ranges.

SUMMARY OF THE INVENTION

This invention has been developed for the purpose of obviating the aforesaid disadvantages of the prior art. Accordingly the invention has as its object the provision of a two stroke cycle spark ignition type internal combustion engine wherein the output power and the fuel consumption rate are improved in all the rotation ranges.

The outstanding characteristics of the invention are that, in an engine of a maximum output power at about 8000 rpm, at least two (2) ignition plugs are provided to each cylinder, and projections are formed on the inner wall surface of each cylinder head to cause a squishy current to be produced, and that a delay circuit is provided to the ignition device for delaying the ignition timing in the high-speed rotation range, to accomplish the aforesaid object.

The above and further objects and novel features of the invention will more fully appear from the following detailed description when the same is read in connection with the accompanying drawing. It is to be expressly understood, however, that the drawing is for purpose of illustration only and is not intended as a definition of the limits of the invention.

BRIEF DESCRIPTION OF THE DRAWINGS

The drawing illustrate the embodiments of the invention.

DESCRIPTION OF THE PREFERRED EMBODIMENTS

Figure 1:
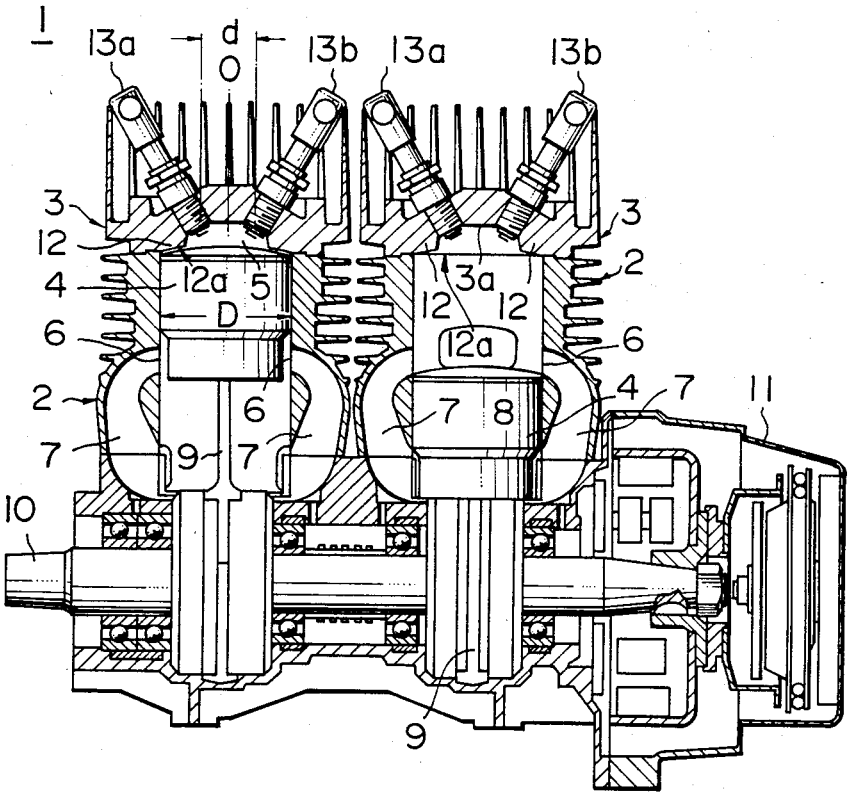
FIG. 1 is a central vertical sectional view of the spark ignition type internal combustion engine comprising one embodiment.

Referring to FIG. 1, a two-cylinder internal combustion engine of the spark ignition type generally designated by the numeral 1 is a two-cycle engine capable of developing high output power and operating at high speed with a maximum output power at about 8000 rpm, which comprises cylinder blocks 2, cylinder heads 3, pistons 4, connecting rods 9, a crank shaft 10 and a starter means 11. Combustion chambers 5 are each communicated with both scavenging passageways 7 formed in each cylinder block 2 through both scavenging ports 6 and with an exhaust passage, not shown, through a discharge port 8. Thus the both scavenging ports 6 are disposed on opposite sides of the discharge port 8 to constitute a Schnuller scavenging system in which scavenging currents through the scavenging ports 6 in a scavenging stroke impinge against the inner wall surfaces of each cylinder block 2 and each cylinder head 3 and reverse their directions of flows to form a current that flows into the discharge port 8.

Each cylinder head that defines each combustion chamber 5 is formed on its inner wall surface with projections 12 at the lower end edge thereof which extend into the combustion chamber 5. The projections 12 are contiguous with a hemispherical portion 3*a* of the inner wall surface of the cylinder head 3 at their upper portions and face the upper surface of the piston 4 at their undersides. Thus a squishy current is produced in the vicinity of a compression top dead center at which the piston 4 is disposed in the vicinity of the top dead center so as to cause rapid combustion of the mixture by utilizing the squishy current.

Figure 9:
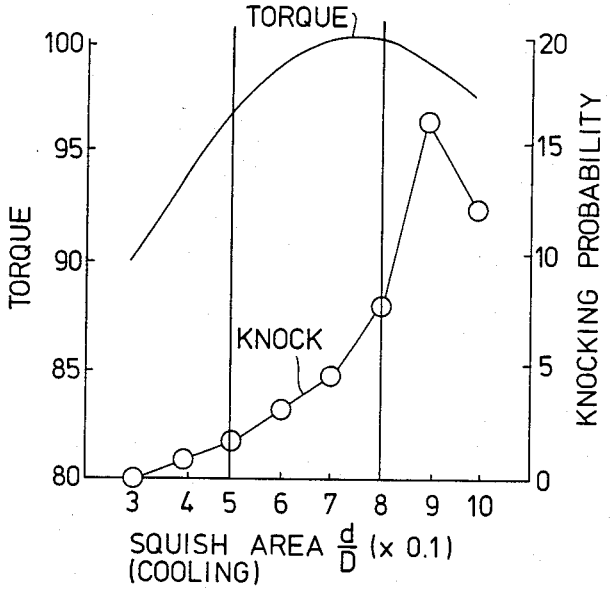
FIG. 9 is a graph showing the relation between torque (left ordinate) or knock probability (right ordinate) and squish area in terms of the dimensionless number d'/D, where d'=inner diameter of the annular squish area.

FIG. 9 shows how torque and knock characteristics vary depending on the squish area. It is shown that a squish area of about 0.5 to about 0.8 (d'/D) is preferred for high torque and low knock probability. A squish area of about 0.5 is preferred for a high output power engine while a swuish area of about 0.8 is preferred for a low output power engine.

Figure 2:
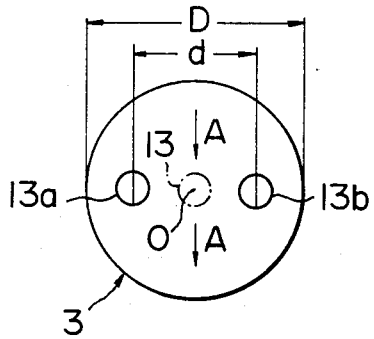
FIG. 2 is a schematic view of the cylinder head showing the positions in which the spark plugs are mounted.

Each cylinder head 3 has two ignition plugs 13*a* and 13*b* projecting through the hemispherical inner wall surface portion 3*a* and oriented, as shown in FIG. 2, in a direction in which they are normal to the direction of flow of the scavenging current of the Schnuller scavenging system. Moreover, the two ignition plugs 13*a* and 13*b* are positioned such that they are equidistantly spaced apart from the center O of the inner diameter of the cylinder block 2 and the distance d between the two ignition plugs 13*a* and 13*b* is in the range 0.45 D>d>0.35 D where D is the inner diameter of the cylinder block 2. Thus the distance that should be covered by the flames when they spread is reduced, to cause rapid combustion of the fuel to take place.

Figure 8:
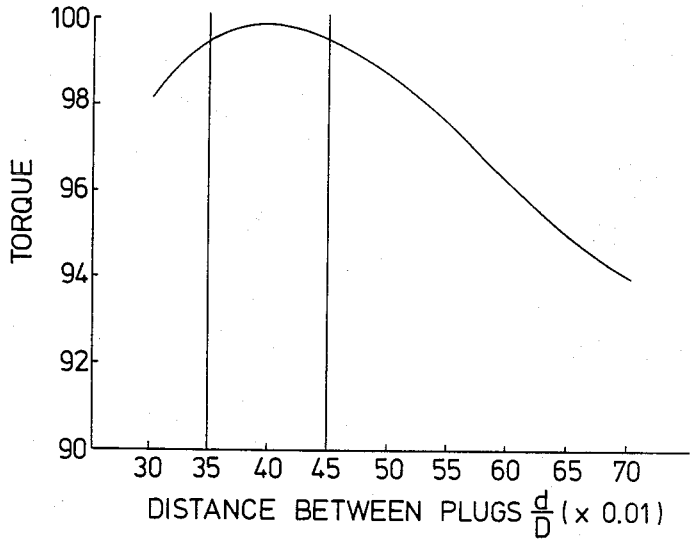
FIG. 8 is a graph showing the relation between torque of engine and distance between spark plugs in terms of the dimensionless number d/D, where d=distance between plugs and D=inner diameter of cylinder.

FIG. 8 shows the relation between the distance d between the ignition plugs and engine torque under conditions of high speed and wide open throttle. As seen, torque is maximized in the range of about 0.35 to about 0.45 d/D.

Figure 3:
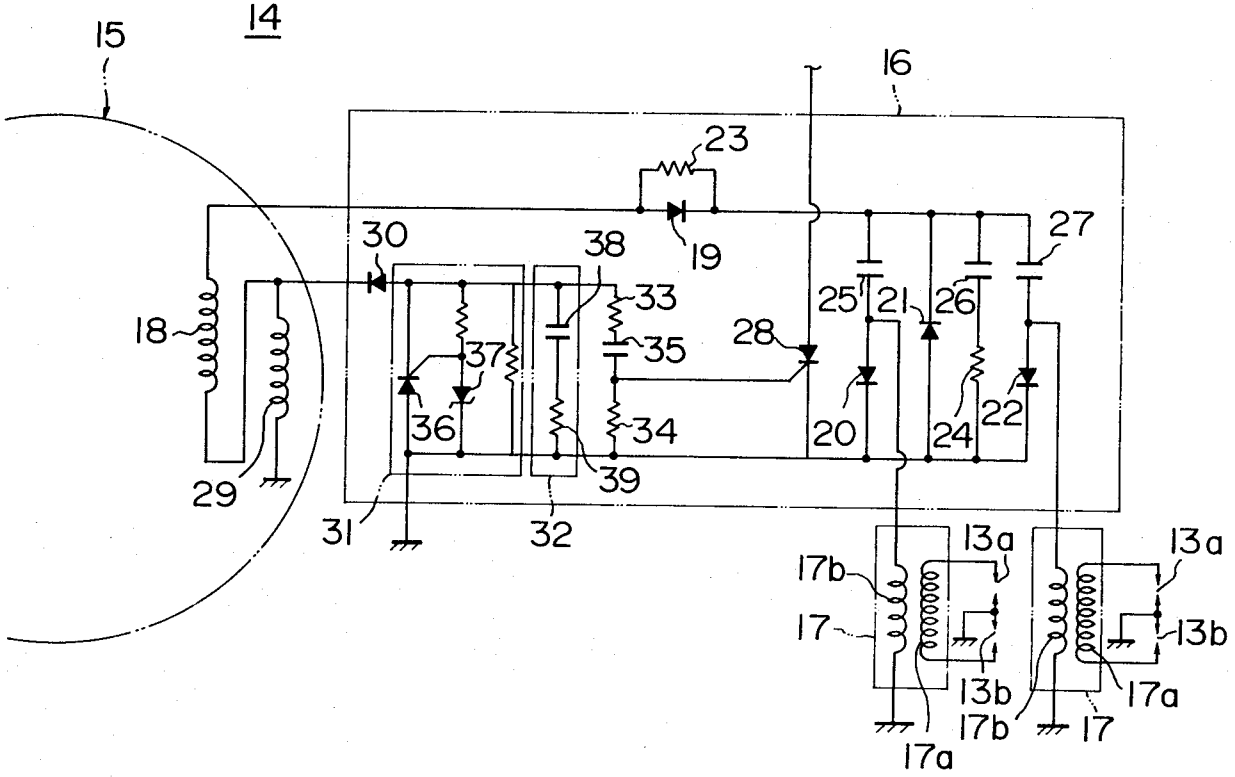
FIG. 3 is an electric circuit diagram showing the ignition device.

Referring to FIG. 3, the ignition plugs 13*a* and 13*b* have connected thereto a contactless ignition device of the flywheel magnet type (C.D.I.) 14 which comprises a magnet 15, a C.D.I. unit 16 and two ignition coils 17, each ignition coil 17 having the ignition plugs 13*a* and 13*b* connected to a secondary coil 17*a* thereof. The C.D.I. unit 16 has connected thereto diodes 19, 20, 21 and 22, resistors 23 and 24, capacitors 25, 26 and 27, and a thyristor 28 which are connected to an exciter coil 18 of the magnet 15. The ignition coil 17 has a primary coil 17*b* connected in series with the capacitors 25 and 27. The C.D.I. unit 16 has connected thereto a diode 30, a constant voltage circuit 31, delay circuit 32, resistors 33 and 34, and a capacitor 35 which are connected to a pulser coil 29 of the magnet 15, and the capacitor 35 is connected in series with a gate terminal of the thyristor 28. The constant voltage circuit 31 includes a thyristor 36 and a Zener diode 37. When the output voltage of the pulser coil 29 reaches the Zener voltage, the thyristor 36 is fired and fires the discharge thyristor 28 of the capacitor 35, so as to simultaneously ignite the two spark plugs 13*a* and 13*b* of each cylinder.

The delay circuit 32 includes a capacitor 38 and a resistor 39 connected in series with each other. Since the impedance is lowered as the number of revolutions rises above the number of revolutitons set for the intermediate-speed rotation range, the time required for reaching the predetermined voltage is delayed, to thereby delay the ignition for the thyristor 28 and to delay the timing of ignition of the ignition plugs 13*a* and 13*b* by about 10 degrees behind the most advanced timing in the high-speed rotation range (over about 6000 rpm).

The performance of the internal combustion engine 1 of the aforesaid construction will now be described together with its operation.

Actuation of the crank shaft 10 by the starter means 11 moves the pistons 4 vertically and at the same time energizes the exciter coil 18 so that a signal current from the pulser coil 29 simultaneously ignites the fuel-air mixture by the two ignition coils 13*a* and 13*b* for each cylinder. Thus the internal combustion engine 1 is driven.

Figure 4:
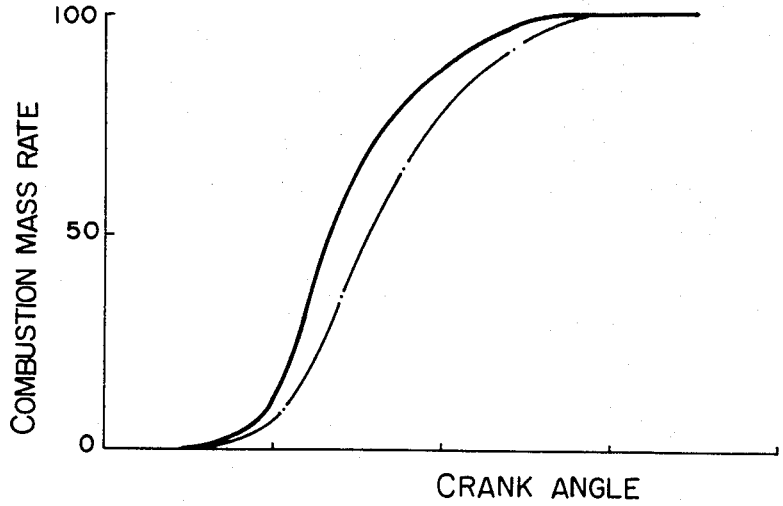
FIG. 4 is a graph showing the combustion mass rate in relation to the crank angle.

When the internal combustion engine is driven as aforesaid, the fuel in each combustion chamber 5 is rapidly burned as indicated by a solid line in FIG. 4. In FIG. 4, a dash-and-dot line represents an internal combustion engine of the prior art in which one ignition plug 13 is located in the center of the cylinder head in a dash-and-dot line position in FIG. 2. In the internal combustion engine according to the invention, the combustion mass rate increases more rapidly than in the internal combustion engine of the prior art. For example, the time for the combustion mass rate to reach 50% is shortened by about five (5) degrees in crank angle, indicating that combustion is progressing rapidly.

Figure 5:
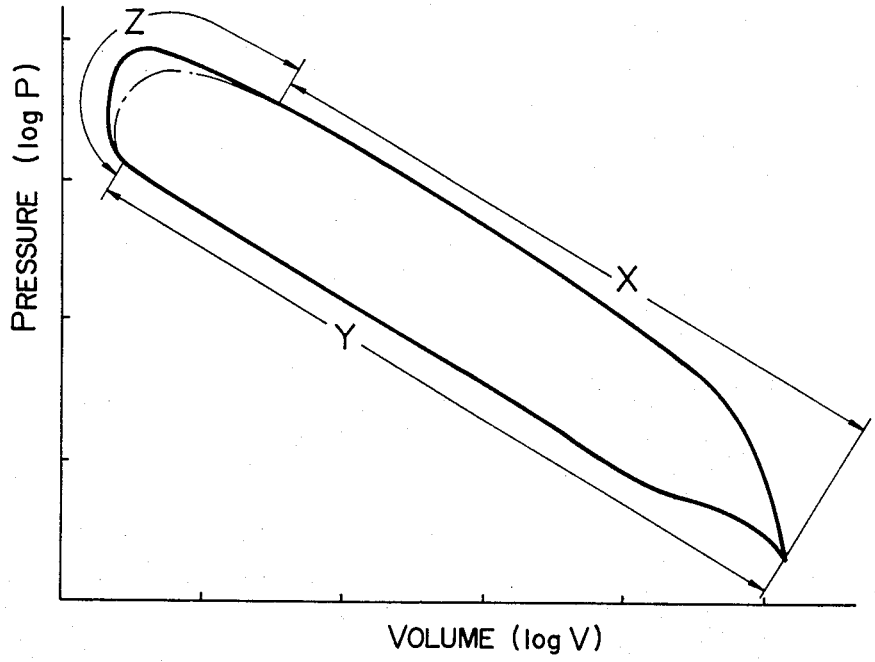
FIG. 5 is a graph showing the pressure-volume characteristic of the cylinder.

Also, in the vicinity of the compressing top dead center, a squishy current is produced by the projections 12 which increase the speed at which the fuel is combusted. Thus combined with the production of the squishy current, the provision of the two ignition plugs 13*a* and 13*b* for each cylinder can improve the output power and the fuel consumption rate in low- and medium-speed rotation ranges up to about 6000 rpm. FIG. 5 shows a pressure-volume curve for the cylinder in which a solid line represents the invention and a dash-and-dot line indicates the prior art with one ignition plug indicated at 13 in FIG. 2. It will be seen that although the pressure in the cylinder according to the invention is substantially equal to that of the prior art in both the compression stroke X and the expansion stroke Y, the pressure in the cylinder is higher in the combustion stroke Z according to the invention than in the prior art, indicating that improvements are provided to both the output power and the fuel combustion rate.

Figure 10:
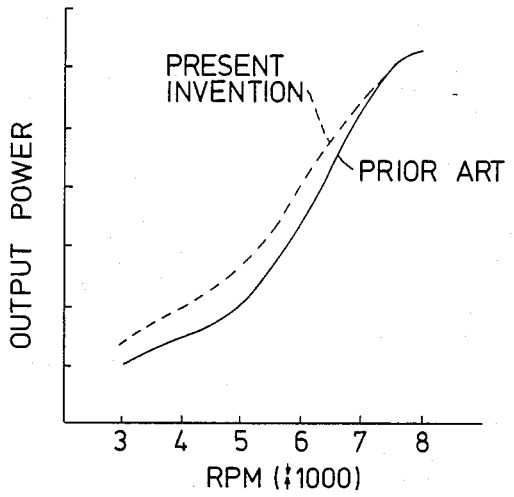
FIG. 10 is a graph showing output power of an engine according to this invention compared with a conventional engine.
Figure 11:
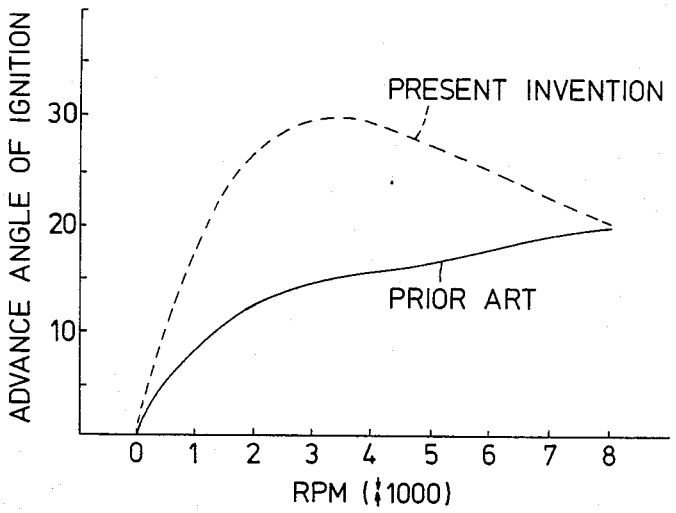
FIG. 11 is a graph showing absolute angles of ignition advance employed in an engine according to this invention compared with a conventional engine with relation to engine speed.

FIG. 11 shows advance angles of ignition according to the present invention in comparison with conventional engines. FIG. 10 shows output power of engines having ignition timing characteristics according to the present invention (dotted line) and of conventional engines (solid line), respectively, the characteristics being shown in FIG. 11. Both engines have such a common structure that distance between plugs is in the range of about 0.35 to about 0.45 and squish area is in the range of about 0.5 to about 0.8.

Figure 6:
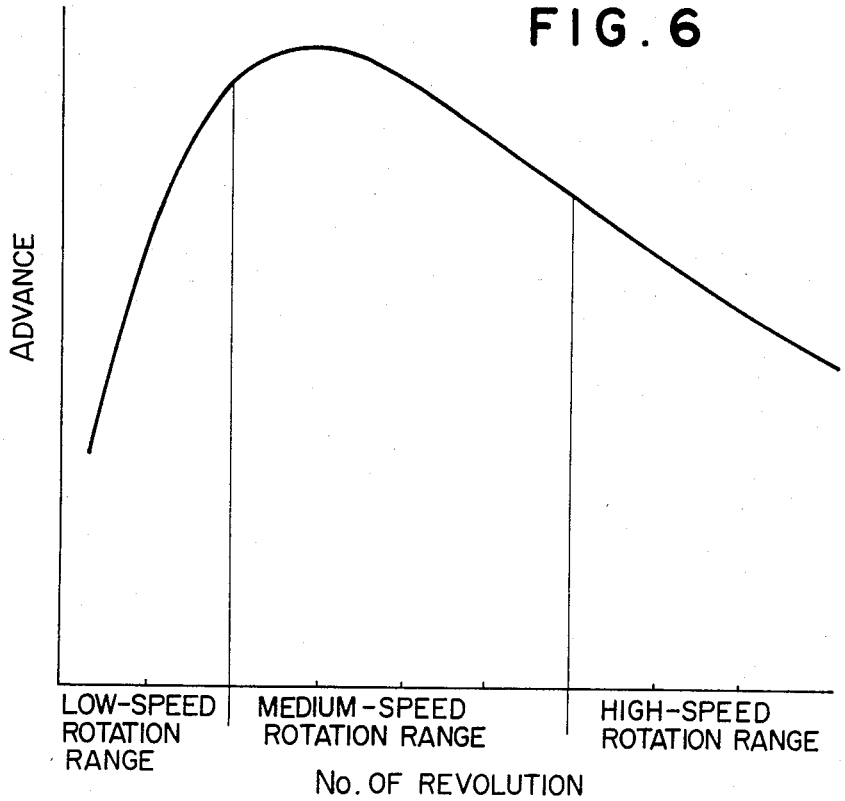
FIG. 6 is a graph showing the advance characteristic of the engine.

FIGS. 6 and 10 show the advance characteristic of the engine according to the invention. Because of the large squish area in an engine according to this invention, there is a cooling of the combustion gases in low and intermediate speed ranges resulting in a so-called ignition lag from the ignition of the ignition plugs to actual start of burning. Due to the prolonged ignition lag, it is required to advance the spark timing by 8–10 degrees more than the advance used in prior art engines, as shown in FIG. 11. Owing to actuation of the ignition device 14, in the low- and medium-speed rotation ranges the charging voltage of the capacitor 38 of the delay circuit 32 is low because the rpm (frequency) of the engine is low, the thyristor 28, capacitors 25 and 27 and ignition coil 17 are actuated in the indicated order, and the two ignition plugs 13*a* and 13*b* are simultaneously actuated, with the ignition time of the ignition plugs 13*a* and 13*b* rapidly advanced with an increase in the engine rpm. Then, the impedance of the capacitor 38 is reduced as the rpm increases in accordance with the time constant decided by the capacitor 38 and resistor 39 of the delay circuit 32 after a peak is reached in the medium-speed rotation range. Thus the time for the voltage applied to the resistors 33 and 34 and capacitor 35 to reach a predetermined value is delayed and consequently the time of actuation of the thyristor 28, capacitors 25 and 27 and ignition coil 17 is also delayed, so that the time for the ignition plugs 13*a* and 13*b* to be actuated is delayed in crank angle as the rotation reaches a high-speed rotation range, until it is delayed by about ten (10) degrees in crank angle in the high-speed rotation range.

The rapid combustion referred to hereinabove improves the output power and fuel consumption rate in the low- and medium-speed rotation ranges, but it would cause abnormal combustion to take place because of an inordinate rise in temperature in the cylinder due to a reduction in ignition delay and rapid progress in combustion in the high-speed rotation range. Thus the invention contemplates delaying of the ignition time when the engine rotates at high speed to thereby avoid the abnormal combustion and improve the output power and fuel consumption rate. This is shown in FIG. 11, which includes the dotted line curve that represents the variation in advance angle over the entire speed range of the engine.

In the embodiment shown and described hereinabove, the two ignition plugs 13*a* and 13*b* are provided. It is to be understood, however, that the invention is not limited to this specific number of the ignition plugs and that more than three (3) ignition plugs may be provided. Also, in case the squishy current provided by the projections 12 is not fully utilized, the ignition device 14 may operate such that the ignition time is delayed by about twenty (20) degrees in crank angle in the high-speed rotation range as compared with the ignition time in the most advanced rotation range.

Figure 7:
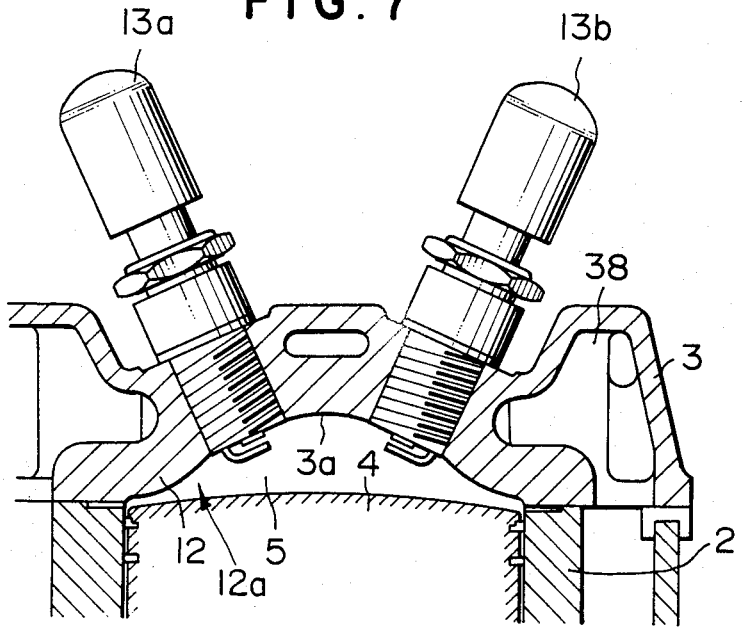
FIG. 7 is a sectional view of the combustion engine of another embodiment.

FIG. 7 shows an application of the invention to a water-cooled engine in which 38 is a water jacket and parts similar to those shown in FIG. 1 are designated by like reference characters of which description is omitted.

From the foregoing description, it will be appreciated that according to the invention at least two ignition plugs are provided to the cylinder head and projections are formed on the inner wall surface of the cylinder head for producing a squishy current while the ignition device for actuating the ignition plugs simultaneously is provided with a delay circuit for delaying the ignition time in high-speed rotation range. By virtue of these features, a rapid combustion of the fuel markedly improves the output power and fuel consumption rate in the low- and medium-speed rotation ranges, and the distance covered by the flames when they spread is reduced and the ignition timing is delayed in the high-speed rotation range to thereby avoid occurrence of abnormal combustion positively. Thus the invention enables the output power and fuel consumption rate to be improved over the entire rotation range.

Owing to the rapid combustion achieved, the precision with which the ignition time is selected in the high-speed rotation need not be so stringent, thereby permitting an ordinary contactless ignition device or other cheap ignition device to be used. Moreover, since no enriched mixture need be used, there is no risk of the fuel consumption rate being reduced and a cheap fuel supply device can be used. A two cycle gasoline engine according to the invention has been operated with a high air-fuel ratio in the range of 13 to 14 without causing any abnormal combustion accompanied by engine damage while, according to the prior art, the same type engine should not be operated above an air-fuel ratio in the range of 12 to 13. Accordingly, with this invention, air-fuel ratios may be used closer to theoretical than enriched to achieve fuel economy. The invention can have application in all two-cycle engines irrespective of the number of cylinders and the system used for cooling the engines.

What is claimed is:

1. A two stroke cycle spark ignition type internal combustion engine comprising:

at least two ignition plugs for each cylinder substantially equidistantly spaced from the center of the cylinder and spaced from each other a distance which is in the range between about 0.35 to about 0.45 (in terms of d/D, where d is the distance between plugs and D is the inner diameter of the cylinder);

projections formed on the inner wall surface of the cylinder head defining a combustion chamber, said projections having undersides facing the upper surface of a piston in the cylinder to provide an annular squish area at the cylinder periphery in the range of about 0.5 to about 0.8 (in terms of d'/D, where d' is the inner diameter of the annular squish area) for producing a squishy current; and an ignition device connected to said ignition plugs for simultaneously actuating the two ignition plugs, sad ignition device including a delay circuit for reducing the advance angle of the ignition timing in the high-speed rotation range as compared with the ignition timing in the most advanced rotation range.

2. A two stroke cycle spark ignition type internal combustion engine as claimed in claim 1, wherein said ignition plugs are two in number and positioned such that they are oriented in a direction perpendicular to the direction of flow of a scavenging current.

3. A two stroke cycle spark ignition type internal combustion engine comprising:

two ignition plugs for each cylinder mounted at a cylinder head, substantially equidistantly spaced from the center of the cylinder and spaced from each other a distance which is in the range between about 0.35 to about 0.45 (in terms of d/D, where d is the distance between plugs and D is the inner diameter of the cylinder), said cylinder head having a hemispherical inner wall surface;

projections formed on the inner wall surface of the cylinder head defining a combustion chamber, said projections having upper portions contiguous with said hemispherical portion of the inner wall surface of the cylinder head and the ignition plugs, said projections having undersides facing the upper surface of a piston in the cylinder to provide an annular squish area at the cylinder periphery in the range of about 0.5 to about 0.8 (in terms of d'/D, where d' is the inner diameter of the annular squish area) adjacent said ignition plugs; and an ignition device connected to said ignition plugs for simultaneously actuating said plugs, said ignition device including a delay circuit for reducing the advance angle of ignition timing in the high-speed rotation range as compared with the ignition timing in the most advanced rotation range;

said engine being operable with an air-fuel ratio in the range of about 13 to about 14 supplied to the combustion chamber to provide an improved fuel consumption rate over the entire rotation range of the engine.

* * * * *